US011933140B2

(12) United States Patent
Al-Huwaider et al.

(10) Patent No.: US 11,933,140 B2
(45) Date of Patent: Mar. 19, 2024

(54) WELL CLEANING TOOLS AND RELATED METHODS OF CLEANING WELLS IN OIL AND GAS APPLICATIONS

(71) Applicant: Saudi Arabian Oil Company, Dhahran (SA)

(72) Inventors: Mustafa A. Al-Huwaider, Dhahran (SA); Shouxiang Mark Ma, Dhahran (SA); Nader H. Hwety, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 548 days.

(21) Appl. No.: 17/165,330

(22) Filed: Feb. 2, 2021

(65) Prior Publication Data

US 2022/0243561 A1 Aug. 4, 2022

(51) Int. Cl.
*E21B 37/02* (2006.01)

(52) U.S. Cl.
CPC ..... *E21B 37/02* (2013.01)

(58) Field of Classification Search
CPC ..... E21B 37/02
See application file for complete search history.

(56) References Cited

U.S. PATENT DOCUMENTS 6,085,844 A * 7/2000 Palmer ..... E21B 37/00 166/77.2
6,655,462 B1 12/2003 Carmichael et al.
6,745,839 B1 * 6/2004 Simpson ..... E21B 37/04 166/173
7,051,587 B2 * 5/2006 Simpson ..... E21B 37/00 73/152.54
7,607,478 B2 10/2009 Martinez et al.
7,753,125 B1 7/2010 Penisson
8,408,307 B2 4/2013 Telfer
8,955,584 B2 2/2015 Telfer
9,109,417 B2 8/2015 Leiper et al.
10,526,871 B2 1/2020 Tzallas et al.
2007/0261855 A1 11/2007 Brunet et al.
2008/0066920 A1 * 3/2008 Allcorn ..... E21B 41/0078 166/312
2010/0181064 A1 * 7/2010 Knobloch ..... E21B 31/08 166/99

OTHER PUBLICATIONS bakerhughes.com [online] "VACS G2 system," Baker Hughes, available on or before Oct. 5, 2020, retrieved on Jan. 7, 2021, retrieved from URL <https://www.bakerhughes.com/wellbore-cleanup/vacs-g2-system>, 5 pages.

(Continued)

*Primary Examiner* — Crystal J. Lee
(74) *Attorney, Agent, or Firm* — Fish & Richardson P.C.

(57) ABSTRACT

A method of cleaning a well includes flowing well fluid within the well while running a cleaning tool into the well, injecting the well fluid with a fluid thickening agent through multiple nozzles of the well cleaning tool to form thickened well fluid, dislodging metallic debris and non-metallic debris accumulated along a wall of the well with multiple brushes of the cleaning tool, carrying the non-metallic debris out of the well with the thickened well fluid, and capturing the metallic debris at a capture device of the cleaning tool.

19 Claims, 4 Drawing Sheets

(56) References Cited

OTHER PUBLICATIONS bakerhughes.com [online] "Vectored annular cleaning system (VACS) technology," Baker Hughes, available on or before Oct. 5, 2020, retrieved on Jan. 7, 2021, retrieved from URL https://www.bakerhughes.com/wellbore-cleanup/vectored-annular-cleaning-system-vacs-technology, 4 pages.

Kelder et al., "Expanding advanced production logging operations to short radius horizontal wells," SPE 93526, presented at the 14th SPE Middle East Oil & Gas Show and Conference, Bahrain International Exhibition Centre, Bahrain, Mar. 12-15, 2005, 7 pages.

slb.com [online] "Well Scavenger," Schlumberger, available on or before Aug. 3, 2020, via Internet Archive: Wayback Machine URL <http://web.archive.org/web/20200803130523/https://www.slb.com/completions/fluids-and-tools/wellbore-cleaning-tools/debris-recovery-tools/well-scavenger-vacuum-debris-removal-tool>, retrieved on Jan. 12, 2021, URL <https://www.slb.com/completions/fluids-and-tools/wellbore-cleaning-tools/debris-recovery-tools/well-scavenger-vacuum-debris-removal-tool>, 5 pages.

wildcatoiltools.com [online] "Hydro Vortex," Wildcat Oil Tools, available on or before Oct. 5, 2020, retrieved on Jan. 12, 2021, retrieved from URL <https://www.wildcatoiltools.com/hydrovortex>, 5 pages.

* cited by examiner

WELL CLEANING TOOLS AND RELATED METHODS OF CLEANING WELLS IN OIL AND GAS APPLICATIONS

TECHNICAL FIELD

This disclosure relates to well cleaning tools and related methods of cleaning wells.

BACKGROUND

During a drilling operation carried out at a well, varying amounts of drill cuttings and other particulates can accumulate along a wall of the well. In some instances, sticky petroleum residues may also accumulate along the wall, depending on pressure-volume-temperature (PVT) properties of oil produced at the well during well production, and especially along well trajectories in highly deviated and horizontal wells. In vertical and slightly deviated wells, these various types of debris may accumulate in a rathole at a bottom end of the well as a result of gravity segregation. However, in horizontal wells, the debris may distributed along a length of the well, which can cause accessibility and logging problems, such as equipment malfunctions or even damage to spinners of production logs.

SUMMARY

This disclosure relates to a well cleaning tool that is designed to remove debris that have accumulated along a wall of a well within a rock formation. Such debris may include drill cuttings, sticky petroleum residues, sand, or other particulates. The well cleaning tool can be deployed to the well and operated to disturb the debris to dislodge the debris from the wall while well fluid flows from the well so that the debris can be carried away with the well fluid. The well cleaning tool includes a steerable assembly sub (SAS) at a downhole end to direct the well cleaning tool forward, a conveying device for moving the well cleaning tool forward or backward and radially centering the well cleaning tool, a brush assembly for agitating the debris along the wall, and an electric motor for rotating the brush assembly. The well cleaning tool further includes an electromagnetic coil for capturing metallic debris that has been dislodged by the brush assembly, a noise detector for monitoring noise generated by debris hitting an enclosure of the noise detector, a bow centralizer for centrally positioning the well cleaning tool, and multiple nozzles for jetting substances (for example, cleaning fluids) that can aid in a cleaning operation carried out at the well.

In some examples, the well cleaning tool may be deployed to the well to clean the well after a drilling operation has been completed. In other examples, the well cleaning tool may be deployed to the well during an operation at the well, such as while the well is producing oil, gas, and/or water or while the well is being injected (for example, with treated water to maintain reservoir pressure).

In one aspect, a well cleaning tool includes a positioning device configured to control a position of the well cleaning tool within a well, a rotatable brush assembly configured to scrape a wall of the well, a capture device configured to catch debris dislodged from the wall by the rotatable brush assembly, and a fluid delivery assembly configured to deliver a cleaning fluid to the well.

Embodiments may provide one or more of the following features.

In some embodiments, the positioning device includes a steerable assembly sub located at a downhole end of the well cleaning tool, and the steerable subassembly is operable to sense an end of the well or detect an opening of a lateral of the well and direct the well cleaning tool to the lateral.

In some embodiments, the positioning device includes a conveying device that is configured to move the well cleaning tool in a downhole direction or in an uphole direction within the well.

In some embodiments, the conveying device includes an elongate housing and a multiple traction arms that are carried on the elongate housing, wherein the multiple traction arms are adjustable between a retracted configuration in which the multiple traction arms are substantially collapsed against the elongate housing and an extended configuration in which the multiple traction arms are extended radially from the elongate housing toward the wall of the well to substantially contact the wall of the well.

In some embodiments, the positioning device includes a flexible centralizer that is configured to radially center the well cleaning tool within the well.

In some embodiments, the rotatable brush assembly includes multiple flexible brushes that extend radially from a central axis of the well cleaning tool toward the wall of the well.

In some embodiments, the multiple flexible brushes are arranged in a helical pattern.

In some embodiments, the well cleaning tool further includes a motor assembly that is configured to rotate the rotatable brush assembly.

In some embodiments, the motor assembly includes an electric motor and a gear arrangement configured to transfer rotational motion from the electric motor to the rotatable brush assembly.

In some embodiments, the debris includes metallic debris, and the capture device includes an electromagnetic coil that is configured to attract the metallic debris.

In some embodiments, the well cleaning tool further includes a noise detector that is configured to detect noise resulting from contact between the debris and a housing of the noise detector and a surface expert system that is configured to further monitor behavior of the debris in the wellbore.

In some embodiments, the fluid delivery assembly includes a fluid hub body, first nozzles carried on the fluid hub body, and second nozzles carried on the fluid hub body.

In some embodiments, the first nozzles are arranged substantially equidistantly about a circumference of the fluid hub body, and the second nozzles are arranged substantially equidistantly about the circumference of the fluid hub body.

In some embodiments, the first nozzles are oriented perpendicular to a central axis of the well cleaning tool, and the second nozzles are oriented at an acute angle with respect to the central axis.

In some embodiments, the first nozzles are positioned downhole of the second nozzles.

In some embodiments, the first nozzles are positioned uphole of the second nozzles.

In some embodiments, each of the first nozzles and the second nozzles is configured to deliver a jet of fluid to the well at a selected pressure.

In some embodiments, the positioning device, the rotatable brush assembly, and the fluid delivery device are coupled to one another in a substantially in-line arrangement.

In some embodiments, the well cleaning tool further includes a control unit that is configured to control operations of one or more of the positioning device, the rotatable brush assembly, the capture device, and the fluid delivery device.

In some embodiments, the well cleaning tool further includes an electric cable that extends through the well cleaning tool to relay signals from the control unit.

In another aspect, a method of cleaning a well includes flowing well fluid within the well while running a cleaning tool into the well, injecting the well fluid with a fluid thickening agent through multiple nozzles of the well cleaning tool to form thickened well fluid, dislodging metallic debris and non-metallic debris accumulated along a wall of the well with multiple brushes of the cleaning tool, carrying the non-metallic debris out of the well with the thickened well fluid, and capturing the metallic debris at a capture device of the cleaning tool.

Embodiments may provide one or more of the following features.

In some embodiments, the method further includes flowing the well fluid in an uphole direction and advancing the cleaning tool into the well in a downhole direction.

In some embodiments, the multiple nozzles are configured to direct the fluid thickening agent in the uphole direction.

In some embodiments, the method further includes navigating the well with a positioning device of the cleaning tool.

In some embodiments, the positioning device includes a steerable assembly sub located at a downhole end of the cleaning tool for sensing an end of the well or detecting an entry opening of a targeted lateral of the well.

In some embodiments, the method further includes navigating the well using multiple traction arms of the positioning device.

In some embodiments, the method further includes radially centering the cleaning tool within the well using a flexible frame of the positioning device.

In some embodiments, the well fluid is injected with the fluid thickening agent through the multiple nozzles at a first pressure, and the method further includes withdrawing the cleaning tool from the well while injecting the well fluid with the fluid thickening agent through the multiple nozzles at a second pressure that is less than the first pressure.

In some embodiments, the method further includes rotating an assembly including the multiple brushes about a central axis of the cleaning tool and scraping the wall of the well with the multiple brushes.

In some embodiments, the multiple brushes are arranged in a helical pattern.

In some embodiments, the capture device includes an electromagnetic coil.

In some embodiments, the method further includes deactivating the capture device and releasing the metallic debris to a downhole end of the well.

In some embodiments, the method further includes withdrawing the cleaning tool from the well with the capture device in a deactivated state.

In some embodiments, the method further includes controlling operation of components of the cleaning tool at a control unit of the cleaning tool located at a surface of the well.

In some embodiments, the well is a horizontal well.

In some embodiments, the method further includes flowing well fluid within the well while running the cleaning tool into the well, jetting a dissolving fluid through the multiple first nozzles and through multiple second nozzles of the cleaning tool into the well, breaking down substances stuck to the wall of the well with the dissolving fluid to form broken down substances, and releasing the broken down substances to the well fluid. The method further includes running the cleaning tool into the well, injecting the well fluid with the fluid thickening agent, dislodging metallic and non-metallic debris from the wall, carrying the non-metallic debris out of the well, and capturing the metallic debris at a capture device.

In some embodiments, the substances include sticky petroleum residues.

In some embodiments, the dissolving fluid includes one or more of an acid, a solvent, or steam.

In some embodiments, the second nozzles are oriented perpendicular to a central axis of the cleaning tool, and the first nozzles are oriented at an acute angle with respect to the central axis.

In some embodiments, the dissolving fluid is jetted into the well at a first pressure, and the method further includes withdrawing the cleaning tool from the well while jetting the dissolving fluid into the well at a second pressure that is less than the first pressure.

The details of one or more embodiments are set forth in the accompanying drawings and description. Other features, aspects, and advantages of the embodiments will become apparent from the description, drawings, and claims.

DETAILED DESCRIPTION

Figure 1:
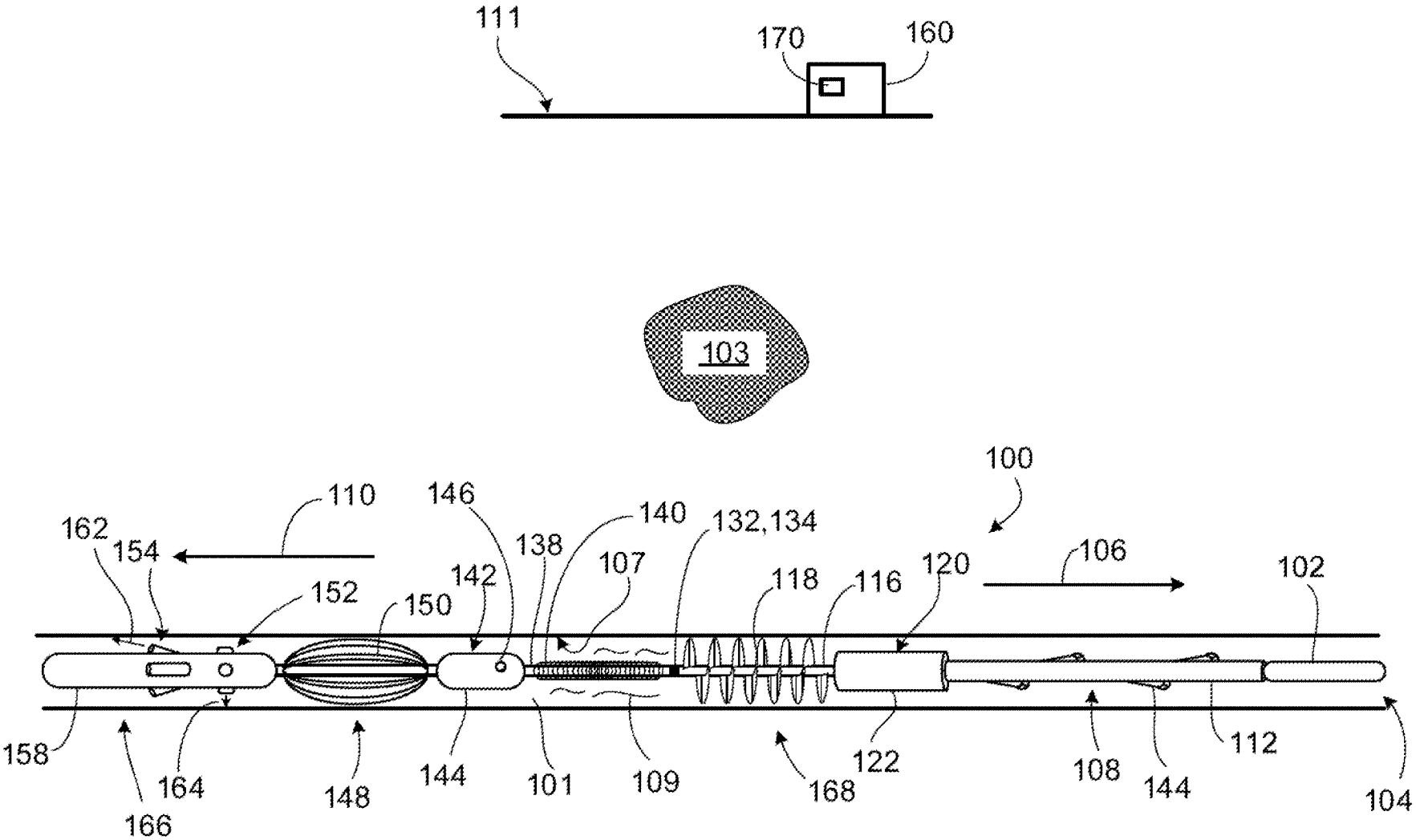
FIG. 1 is a side view of an example well cleaning tool with a conveying device in a retracted configuration.
Figure 2:
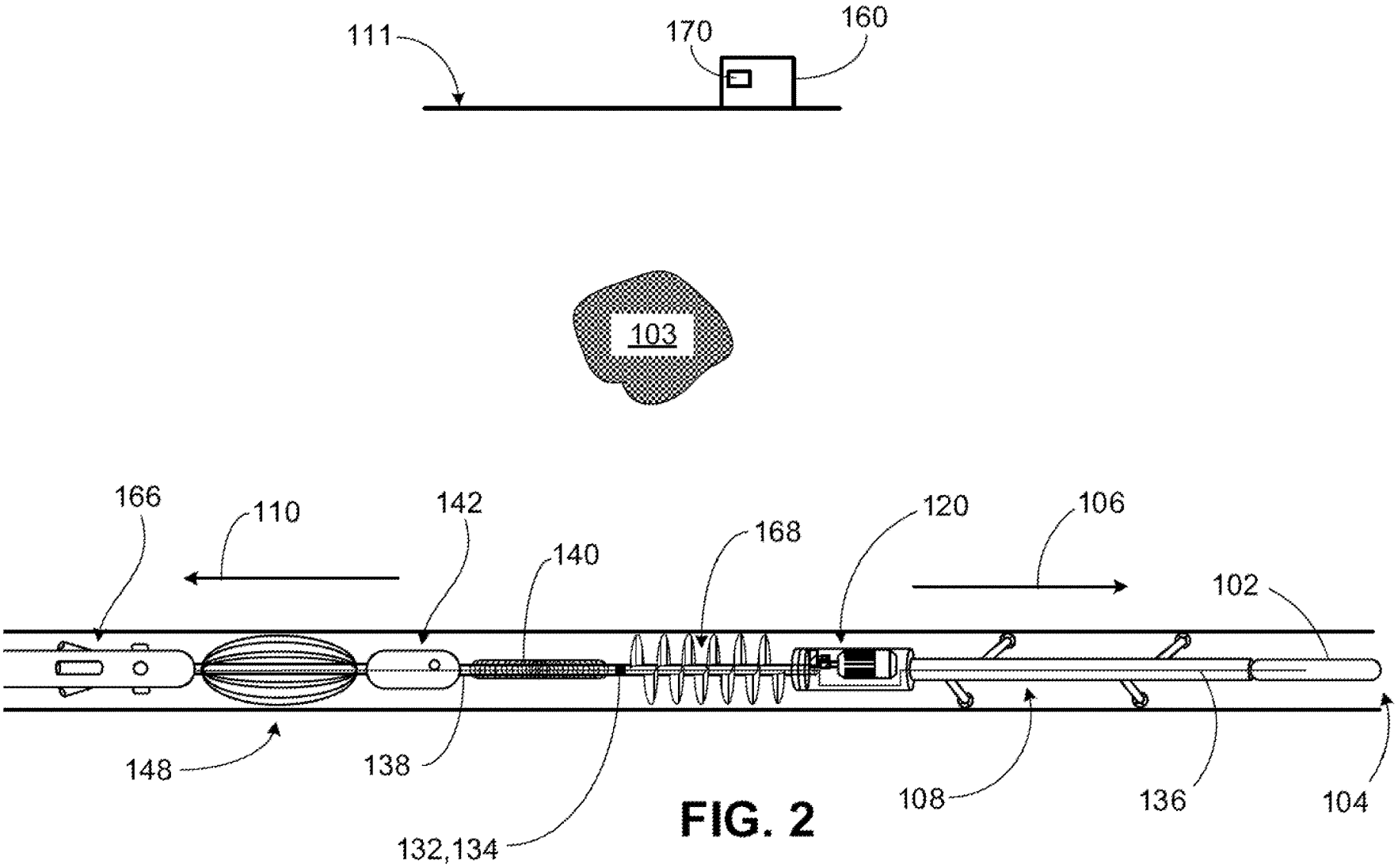
FIG. 2 is a side view of the well cleaning tool of FIG. 1 with the conveying device in an extended configuration.

FIGS. 1 and 2 illustrate an example well cleaning tool 100 disposed within a well 101 of a rock formation 103. The well cleaning tool 100 is designed to remove debris 105 (shown in FIG. 3) that have accumulated along a wall 107 of the well 101. Such debris may include drill cuttings, sticky petroleum residues, sand, or other particulates that remain on the wall 107 after a drilling operation or that have formed during production of well fluid 109 (for example, oil and/or gas) at the well 101. The well cleaning tool 100 can be deployed to the well 101 (for example, on coiled tubing) and activated to scrape the wall 107 of the well to agitate the debris 105. The agitated debris 105 become dislodged from the wall 107 and can be carried away (for example, out of the well 101 in the uphole direction 110) with the well fluid 109.

The well cleaning tool 100 has a maximum diameter that is smaller than a minimum restriction of the well 101. The well cleaning tool 100 includes a control unit 160 that is located at the surface 111 of the rock formation 103 for controlling various other downhole components of the well cleaning tool 100 via signal communication carried on a wireline 136 that extends from coiled tubing on which the well cleaning tool 100 is deployed. For example, the well cleaning tool 100 includes a steerable assembly sub (SAS) 102 at a downhole end 104 for directing (for example, guiding) the well cleaning tool 100 forward (for example, in a generally downhole direction 106) into various lateral well sections and through a main section of the well 101. The well cleaning tool 100 also includes a conveying device 108

(for example, a tractor) for selectively moving the well cleaning tool 100 forward or backward (for example, in a generally uphole direction 110). The conveying device 108 includes an elongate housing 112 and multiple traction arms 114 that extend radially from the housing 112. In the example embodiment of FIGS. 1 and 2, the conveying device 108 includes four traction arms 114. However, in other embodiments, the conveying device 108 may include a different number of traction arms 114.

The housing 112 typically has a length of about 5 meters (m) to about 10 m, and the traction arms 114 typically have a length of about 10 centimeters (cm) to about 30 cm. The traction arms 114 may be placed in a retracted configuration in which the traction arms 114 are relatively collapsed against the housing 112 during tripping, as shown in FIG. 1. The traction arms 114 may alternatively be placed in an extended configuration in which the traction arms 114 extend radially from the housing 112 toward the wall 107 of the well 101 to grip the wall 107 and to radially center the well cleaning tool 100 within the well 101 during operation, as shown in FIG. 2. In the extended configuration, the traction arms 114 may be oriented at an angle of about 0 degrees to about 45 degrees from the housing 112. For example, once the well cleaning tool 100 reaches a section of the well 101 that is oriented at or above at least a threshold angle (for instance, upon reaching a highly deviated or horizontal well section), the traction arms 114 may be manually activated to help convey the well cleaning tool 100 forward. In some examples, the threshold angle may be at least about 60 degrees. In some embodiments, a desired maneuverability of the well cleaning tool 100 is achieved by the modularity of its various components, which may be connected by knuckle joints. For example, the shorter the axial length of the components of the well cleaning tool 100, the more flexible the well cleaning tool 100 is in movement and the higher is the well dog-leg that can be overcome by the well cleaning tool 100.

The well cleaning tool 100 also includes a brush assembly 168 with a shaft 116 that is equipped with multiple flexible brushes 118 for agitating the debris 105 along the wall 107. In order to ensure that the brushes 118 can make contact with the wall 107 of the well 101 to effect cleaning, the brush assembly 168 has a diameter that is larger than that of the well 101 when the brush assembly 168 is in operation. However, the brush assembly 168 is also flexible enough to pass through small restrictions within production tubing when the brush assembly 168 is not in operation. The well cleaning tool 100 typically has 1 to 100 brushes 118, and each brush 118 typically has a radial length of about 5 cm to about 50 cm. The shaft 116 typically has a length of about 0.5 m to about 10 m. The brushes 118 are continuously distributed about a circumference of the shaft 116 in a helical pattern (for example, a spiral pattern), such that when the shaft 116 is rotated, the brushes 118 rotate helically to agitate and thereby push the debris 105 in the uphole direction 110 within a flow of the well fluid 109. Accordingly, the well cleaning tool 100 further includes a motor assembly 120 for rotating the shaft 116. In other examples, the brushes 118 can push the debris 105 in the downhole direction 106 when the motor assembly 120 is rotated in an opposite direction.

Figure 3:
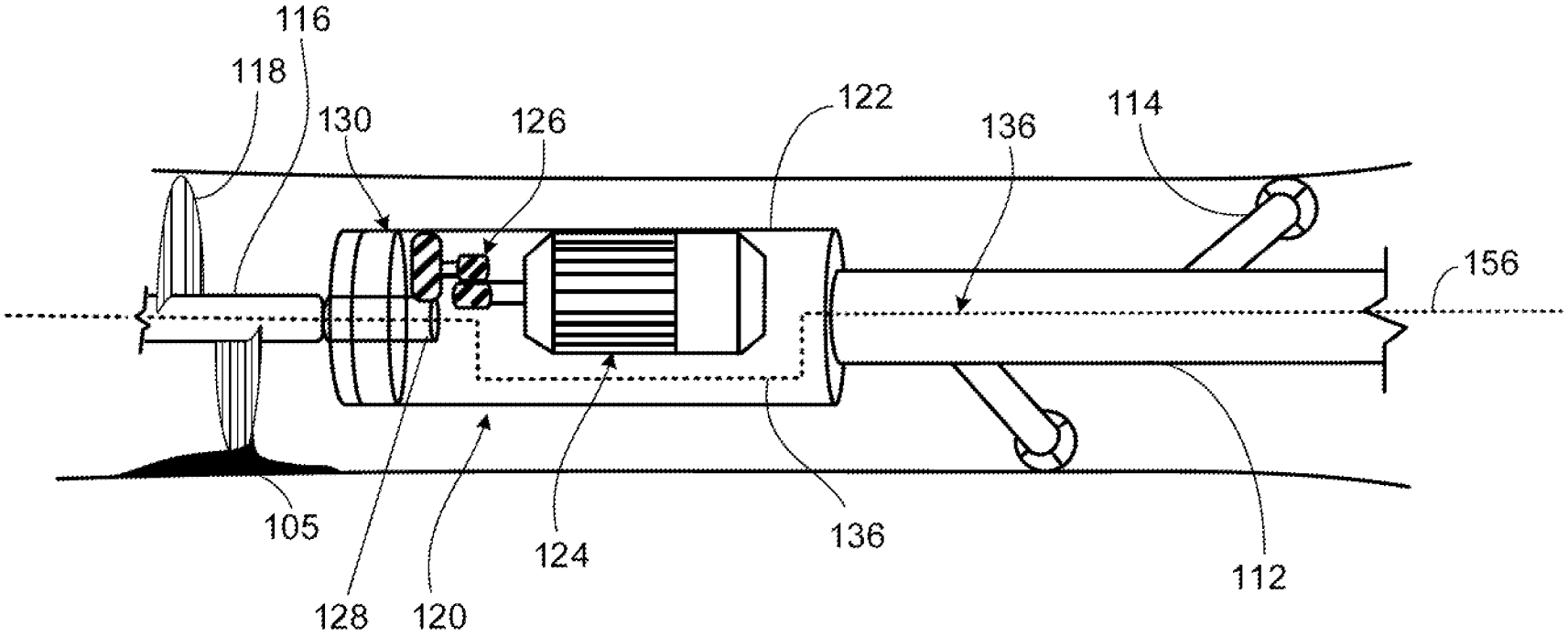
FIG. 3 is an enlarged side view of a portion of the well cleaning tool of FIG. 1.

Referring to FIG. 3, the motor assembly 120 includes a sealed housing 122 that contains an electric motor 124 and a gear arrangement 126 that transfers rotational motion from the electric motor 124 to a downhole end 128 of the shaft 116. The shaft 116 is equipped with a bearing 130 that secures the downhole end 128 of the shaft 116 to the motor assembly 120 within the housing 122. The shaft 116, the housing 122 of the motor assembly 120, the housing 112 of the conveying device 108, and the SAS 102 are all hollow structures through which the wireline 136 passes to deliver electrical signals originating from the control unit 160 to the respective components.

Another bearing 132 couples an uphole end 134 of the shaft 116 to a hollow pipe segment 138 through which the wireline 136 also passes. The well cleaning tool 100 further includes an electromagnetic (EM) coil 140 that attracts (for example, captures) metallic debris 105 dislodged from the wall 107 of the well 101 by the brushes 118, as well as a noise detector 142. The EM coil 140 typically has a diameter of about 3 cm to about 5 cm and a length of about 5 cm to about 50 cm. The noise detector 142 includes a hollow housing 144 and a detection device 146 located within the housing 144. The detection device 146 detects noise from debris 105 that hit the housing 144 as a manner of monitoring and estimating the amount of debris 105 that is being agitated by the brushes 118 and flowed within the well fluid 109. An expert system 170 is built into the control unit 160 so that the noise level and the rotational speed of the electric motor 124 may be monitored to prevent operational complications. In this manner, the expert system 170 helps to optimize the performance of the well cleaning tool 100. If the noise level becomes too high and the electric motor 124 begins to experience resistance to rotation, then a penetration speed of the well cleaning tool 100 should be slowed or stopped until most of the debris 105 has cleared. In some examples, the noise level may be monitored by both a decibel reading and a debris strike rate (for example, a strike count per minute or strike count per second). The noise detector 142 typically has a diameter of about 4 cm to about 10 cm and a length of about 10 cm to about 30 cm.

The well cleaning tool 100 also includes a bow centralizer 148 that is carried on the pipe segment 138. The bow centralizer 148 includes multiple flexible frame members 150 that are distributed about a circumference of the pipe segment 138. The frame members 150 behave like springs such that the bow centralizer 148 can accommodate a variety of tubing and borehole geometries as the well cleaning tool 100 is moved through the well 101. For example, the frame members 150 may remain in contact with the wall 107 of the well 101 to help radially center the well cleaning tool 100 within the well 101 as the bow centralizer 148 is squeezed through even highly deviated sections of the well 101. The bow centralizer 148 may have a maximum diameter of about 10 cm to about 50 cm in a resting state, but can flex to allow the well cleaning tool 100 to be squeezed through well sections with diameters as small as about 5 cm. The bow centralizer 148 typically has a length of about 0.25 m to about 0.5 m.

The well cleaning tool 100 further includes a fluid delivery device 166 with first and second sets of first and second nozzles 152, 154, respectively, for jetting (for example, forcefully flowing) fluidic substances that can aid in a cleaning operation carried out using the well cleaning tool 100. The nozzles 152, 154 are carried on and extend radially from a fluid hub body 158 of the fluid delivery assembly 166. The nozzles 152, 154 are arranged substantially equidistantly about a circumference of the fluid hub body 158. In the example embodiment of the well cleaning tool 100, the first nozzles 152 are positioned downhole of the second nozzles 154 and are oriented perpendicular to a central axis 156 of the well cleaning tool 100 to direct substances radially outward toward the wall 107 of the well 101. The second nozzles 154 are oriented at an acute angle with respect to the central axis 156 and are directed to deliver fluid in the uphole direction 110.

In some embodiments, either or both of the nozzles 152, 154 may be utilized at any given time, depending on operational needs. For example, during a tripping operation, the second nozzles 154 may be used to inject a fluid thickening agent 162 (for example, a viscosifier or a suspension agent) into an uphole-directed flow of the well fluid 109 to increase the viscosity of the well fluid 109 and thereby help carry heavy debris 105 away from the well cleaning tool 100. In other situations, such as during flow of the well 101, the first nozzles 152 may be used to jet a fluid thickening agent 162 or a dissolving fluid 164 (for example, acid, solvents, or hot fluids, such as steam) toward the wall 107 of the well 101 to dissolve or otherwise break down sticky petroleum residues that have accumulated along the wall 107, while the second nozzles 154 are used to jet the same fluid for carrying heavy debris 105 away from the well cleaning tool 100. Furthermore, in some embodiments, axial positions of the first and second sets of nozzles 152, 154 may be swapped as desired for operational goals.

In operation, the well cleaning tool 100 is deployed to and run into the well 101 (for example, on coiled tubing) with the conveying device 108 in the retracted configuration while the well 101 is flowed with well fluid 109. Various components of the well cleaning tool 100 may be subsequently operated as governed by the control unit 160 according to certain conditions present at the well 101. For example, sand, drill cuttings, and other debris particulates may be accumulated along the wall 107 of the well 101, with or without sticky petroleum residues.

In cases for which sticky petroleum residues are not accumulated in substantial amounts on the wall 107 of the well 101, the following process may be carried out. Once the well cleaning tool 100 reaches a target section within the well 101, the traction arms 114 of the conveying device 108 are placed into the extended configuration to stabilize and radially center the well cleaning tool 100 near the downhole end 104, while the bow centralizer 148 helps to stabilize and radially center the well cleaning tool 100 near an uphole end of the well cleaning tool 100. Furthermore, the electric motor 124, EM coil 140, and noise detector 142 are activated and the second nozzles 154 are opened to jet a fluid thickening agent 162 into the well fluid 109 at a relatively high pressure of about 50,000 kilopascals (kPa) to about 70,000 kPa. In general, the selected jetting pressure may be related to a local mechanical strength of the rock formation 103, which may be estimated from an openhole formation evaluation, such as acoustic logs. Lower pressure may be utilized for softer rock, while higher pressure may be utilized for harder rock. While the second nozzles 154 are open, the brushes 118 are operated to dislodge sand, drill cuttings, and other debris particulates on the wall 107 of the well 101.

Non-metallic debris may be carried away in the thickened well fluid 109, while the noise detector 142 monitors the noise generated by contact between the non-metallic debris and the housing 144 of the noise detector 142, and while the EM coil 140 catches metallic debris. Once the SAS 102 of the well cleaning tool 100 detects and reaches a downhole end of the well 101, the well cleaning tool 100 stops advancing to avoid contact damage, the electric motor 124 is deactivated, and the EM coil 140 is deactivated to dump the metallic debris (for example, to allow the captured metallic debris to fall to the downhole end of the well 101). The electric motor 124 may be optionally reactivated after dumping the metallic debris when the brushes 118 are far enough from the metallic debris while the well cleaning tool 100 is pulled in the uphole direction 110 to clean any remaining debris.

With the electric motor 124 and EM coil 140 deactivated and with the well 101 continuing to flow, the second nozzles 154 are adjusted to jet the fluid thickening agent 162 into the well fluid 109 at a relatively low pressure of about 10,000 kPa to about 30,000 kPa while the well cleaning tool 100 is pulled in the uphole direction 110 or otherwise withdrawn from the well 101. The well cleaning tool 100 may be run into and pulled within the well 101 while being operated as described above as many times as necessary to sufficiently clean the wall 107 of the well 101 (for example, to remove a sufficient amount of debris 105 from the wall 107 of the well 101). In some examples, the well 101 may be cleaned in this manner over a period of about 1 hours (h) to about 12 h, depending on, for example, the length of the well interval that needs to be cleaned. In some instances, a cleaning time may be related to a local mechanical strength of the rock formation 103.

In cases for which sticky petroleum residues are accumulated along the wall 107 of the well 101 in substantial amounts, the electric motor 124 and EM coil 140 are deactivated while tripping. Once the well cleaning tool 100 reaches a target section within the well 101, the traction arms 114 of the conveying device 108 are placed into the extended configuration to stabilize and radially center the well cleaning tool 100 near the downhole end 104, while the bow centralizer 148 helps to stabilize and radially center the well cleaning tool 100 near the uphole end of the well cleaning tool 100. Furthermore, both the first and second nozzles 152, 154 are opened to jet a dissolving fluid 164 into the well 101 at a relatively high pressure of about 50,000 kPa to about 70,000 kPa. The dissolving fluid 164 dissolves or otherwise breaks down the sand, drill cuttings, other debris particulates, and sticky petroleum residues on the wall 107 of the well 101. Once the SAS 102 of the well cleaning tool 100 detects and reaches the downhole end of the well 101, the well cleaning tool 100 stops advancing to avoid contact damage, and the first nozzles 152 are open at low pressure. Furthermore, if a specific lateral of a multilateral well 101 needs to be cleaned with the well cleaning tool 100, then the SAS 102 can direct the well cleaning tool 100 to that specific lateral to clean that lateral.

The second nozzles 154 are adjusted to jet the dissolving fluid 164 at a relatively low pressure of about 10,000 kPa to about 30,000 kPa while the well cleaning tool 100 is withdrawn from the well 101. The well cleaning tool 100 may be run into and pulled within the well 101 while being operated as described above as many times as necessary to sufficiently rid the wall 107 of sticky petroleum residues. In some examples, the well 101 may be cleaned in this manner over a period of about 1 h to about 12 h, depending on, for example, the debris that needs to be cleaned out and the length of the well interval that need to be cleaned. The well cleaning tool 100 is then run back into the well 101 and operated according to the steps described above for cases in which sticky petroleum residues are not accumulated along the wall 107 of the well 101 in substantial amounts. This stage of cleaning may also be carried out as many times as necessary to sufficiently remove other debris from the wall 107 of the well 101.

The above-described design and operational features of the well cleaning tool 100 provide several advantages over conventional well cleaning tools. For example, the well cleaning tool 100 has a dual functionality that addresses both sticky and non-sticky debris at the same apparatus and in a single cleaning operation, whereas conventional cleaning tools are designed to address only one of sticky or non-sticky debris, such that multiple cleaning tools and cleaning operations must be carried out to substantially rid the well of both types of debris. Additionally, the noise detector 142 of the well cleaning tool 100 allows convenient monitoring and estimation of the amount of debris 105 present within the well 101 while the well 101 is cleaned and without having to repeatedly remove the well cleaning tool 100 from the well 101 in order to assess the amount of debris, as is required when using conventional cleaning apparatuses that do not have a built-in debris-monitoring device. Furthermore, the well cleaning tool 100 helps to avoid a plug off condition, for which the well cleaning tool 100 cannot pass a plug off.

Figure 4:
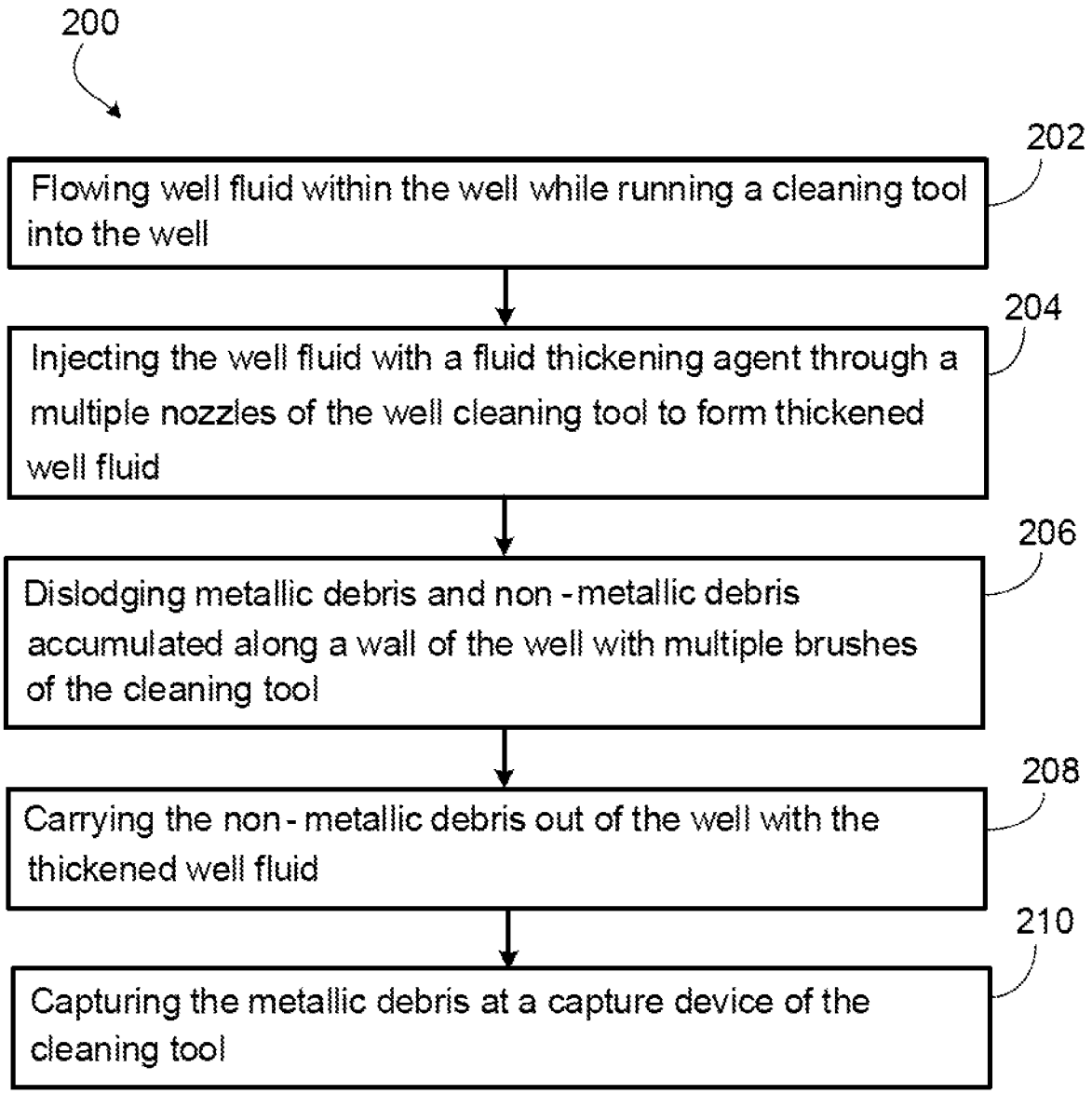
FIG. 4 is a flow chart illustrating an example method of cleaning a well using the well cleaning tool of FIG. 1.

FIG. 4 is a flow chart illustrating an example method 200 of cleaning a well (for example, the well 101). In some embodiments, the method 200 includes a step 202 for flowing well fluid (for example, the well fluid 109) within the well while running a cleaning tool (for example, the well cleaning tool 100) into the well. In some embodiments, the method 200 further includes a step 204 for injecting the well fluid with a fluid thickening agent (for example, the fluid thickening agent 162) through multiple nozzles (for example, either or both of the first and second nozzles 152, 154) of the well cleaning tool to form thickened well fluid. In some embodiments, the method 200 further includes a step 206 for dislodging metallic debris (for example, debris 105) and non-metallic debris (for example, debris 105) accumulated along a wall (for example, the wall 107) of the well with multiple brushes (for example, the brushes 118) of the cleaning tool. In some embodiments, the method 200 further includes a step 208 for carrying the non-metallic debris out of the well with the thickened well fluid. In some embodiments, the method 200 further includes a step 210 for capturing the metallic debris at a capture device (for example, the EM coil 140) of the cleaning tool.

While the well cleaning tool 100 has been described and illustrated with respect to certain dimensions, sizes, shapes, arrangements, materials, and methods 200, in some embodiments, a well cleaning tool that is otherwise substantially similar in construction and function to the well cleaning tool 100 may include one or more different dimensions, sizes, shapes, arrangements, configurations, and materials or may be utilized according to different methods. Accordingly, other embodiments are also within the scope of the following claims.

What is claimed is:

1. A method of cleaning a well, the method comprising:
flowing well fluid within the well while running a cleaning tool into the well;
jetting a dissolving fluid through a plurality of first nozzles of the cleaning tool and through a plurality of second nozzles of the cleaning tool into the well;
breaking down substances stuck to the wall of the well with the dissolving fluid to form broken down substances;
releasing the broken down substances to the well fluid;
injecting the well fluid with a fluid thickening agent through the plurality of first nozzles of the well cleaning tool to form thickened well fluid;
dislodging metallic debris and non-metallic debris accumulated along the wall of the well with a plurality of brushes of the cleaning tool;
carrying the non-metallic debris out of the well with the thickened well fluid; and
capturing the metallic debris at a capture device of the cleaning tool.

2. The method of claim 1, further comprising:
flowing the well fluid in an uphole direction; and
advancing the cleaning tool into the well in a downhole direction.

3. The method of claim 2, wherein the plurality of first nozzles is configured to direct the fluid thickening agent in the uphole direction.

4. The method of claim 1, further comprising navigating the well with a positioning device of the cleaning tool.

5. The method of claim 4, wherein the positioning device comprises a steerable assembly sub located at a downhole end of the cleaning tool for sensing an end of the well or detecting an entry opening of a targeted lateral of the well.

6. The method of claim 4, further comprising navigating the well using a plurality of traction arms of the positioning device.

7. The method of claim 4, further comprising radially centering the cleaning tool within the well using a flexible frame of the positioning device.

8. The method of claim 1, wherein the well fluid is injected with the fluid thickening agent through the plurality of first nozzles at a first pressure, and wherein the method further comprises withdrawing the cleaning tool from the well while injecting the well fluid with the fluid thickening agent through the plurality of first nozzles at a second pressure that is less than the first pressure.

9. The method of claim 1, further comprising:
rotating an assembly comprising the plurality of brushes about a central axis of the cleaning tool; and
scraping the wall of the well with the plurality of brushes.

10. The method of claim 9, wherein the plurality of brushes are arranged in a helical pattern.

11. The method of claim 1, wherein the capture device comprises an electromagnetic coil.

12. The method of claim 11, further comprising:
deactivating the capture device; and
releasing the metallic debris to a downhole end of the well.

13. The method of claim 12, further comprising withdrawing the cleaning tool from the well with the capture device in a deactivated state.

14. The method of claim 1, further comprising controlling operation of components of the cleaning tool at a control unit of the cleaning tool located at a surface of the well.

15. The method of claim 1, wherein the well comprises a horizontal well.

16. The method of claim 1, wherein the substances comprise sticky petroleum residues.

17. The method of claim 16, wherein the dissolving fluid comprises one or more of an acid, a solvent, or steam.

18. The method of claim 1, wherein the second nozzles are oriented perpendicular to a central axis of the cleaning tool, and wherein the first nozzles are oriented at an acute angle with respect to the central axis.

19. The method of claim 1, wherein the dissolving fluid is jetted into the well at a first pressure, and wherein the method further comprises withdrawing the cleaning tool from the well while jetting the dissolving fluid into the well at a second pressure that is less than the first pressure.

* * * * *